US006722515B2

(12) United States Patent
Rumpel

(10) Patent No.: US 6,722,515 B2
(45) Date of Patent: Apr. 20, 2004

(54) FOLDING CRATE

(76) Inventor: Donald Rumpel, 1957 Montgomery Gulch, Kellogg, ID (US) 83837

( * ) Notice: Subject to any disclaimer, the term of this patent is extended or adjusted under 35 U.S.C. 154(b) by 0 days.

(21) Appl. No.: 10/057,169

(22) Filed: Jan. 23, 2002

(65) Prior Publication Data

US 2003/0136781 A1 Jul. 24, 2003

(51) Int. Cl.[7] ..... B65D 21/028
(52) U.S. Cl. ..... 220/6; 220/23.4; 220/23.86
(58) Field of Search ..... 220/6.7, 4.28, 220/23.4, 23.83, 23.86; 441/347, 345, 549; 24/287, 453, 609; 206/504

(56) References Cited

U.S. PATENT DOCUMENTS 1,360,880 A * 11/1920 Buchholtz ..... 40/200
2,975,667 A * 3/1961 Bross ..... 411/521
3,809,279 A * 5/1974 Arjas ..... 220/516
4,044,910 A * 8/1977 Box ..... 220/7
4,062,467 A * 12/1977 Friedrich ..... 220/7
4,789,075 A 12/1988 Sun
4,827,609 A * 5/1989 Kawecki ..... 29/832
4,903,451 A * 2/1990 Gresswell ..... 52/584.1
5,088,619 A * 2/1992 Shank ..... 220/532
5,538,153 A * 7/1996 Marovskis et al. ..... 220/6
5,593,265 A * 1/1997 Kizer ..... 411/552
5,632,392 A * 5/1997 Oh ..... 220/7
5,853,099 A * 12/1998 Lessard ..... 220/7
5,967,356 A * 10/1999 Laarhoven et al. ..... 220/6
6,073,790 A * 6/2000 Umiker ..... 220/6
6,216,872 B1 4/2001 Haasbrock
6,386,388 B1 * 5/2002 Overholt ..... 220/608
6,405,888 B1 * 6/2002 Overholt et al. ..... 220/6
6,409,037 B1 * 6/2002 Lin et al. ..... 220/4.34

* cited by examiner

*Primary Examiner*—Lee Young
*Assistant Examiner*—Joseph C. Merck
(74) *Attorney, Agent, or Firm*—Gregory Law Office

(57) ABSTRACT

A preferred folding crate includes a base having a perimeter. Pivotable side walls fold open from a stacked storage condition in which the walls are in juxtaposition and within the perimeter of the base. A pedestal and legs on the base are arranged so that the pedestal of one crate may be received and secured by the legs of a similar crate having its side walls folded to the stacked storage condition. A preferred crate includes latch members between inner and outer side wall surfaces on a first pair of the side walls. Catch members on a second pair of the side walls are positioned for releasable latch member engagement to secure the side walls in the open condition. Connector receivers, link members and fasteners may be provided to secure successive similar crates together.

16 Claims, 9 Drawing Sheets

FOLDING CRATE

TECHNICAL FIELD

The present invention relates to collapsible containers and more particularly to crates that fold between open operative and closed storage conditions.

BACKGROUND OF THE INVENTION

Wood and plastic crates have long been used for storing or supporting goods for transport. Crates even find use as display tools. Stacks of crates are often used in commercial establishments as display racks. However, unless the crates fold flat, large areas are required for storage. Empty crates require the same storage space as full crates.

Similar problems occur in industries where crates are used for transporting and storing goods. For example, in the dairy industry it is common practice to use molded plastic crates to hold groups of milk containers. One typical form of crate is designed to hold four one gallon milk containers in a rectangular array. While the crates are useful for retail stocking and warehouse handling, problems are encountered when the crates become empty. The crates are designed to be strong and durable, to support the weight of the milk containers. However, empty crates are no longer useful and take up valuable storage space. Disposal is not an alternative since the crates are costly and can readily be re-used.

Problems are realized once again when the empty crates are to be transported. The volume occupied by the empty crates is excessive in relation to the typical payload capability of the cargo carrier. Thus, a cargo van filled with empty crates is not efficiently utilized, and transport becomes a frustrating expense because the cost to transport empty crates is very near the cost to transport the filled crates.

The above problems have been realized and various solutions have been proposed. One considered solution is to make the crates in such a manner that their side walls may be folded to a flat condition. Another is to build the crates in such a manner that they may be dismantled to permit stacking in a more compact condition.

A need remains for a folding crate that may facilitate effective latching of the side walls in the open condition, which may be folded to a compact storage condition and which may be interconnected with other like crates for storage and display purposes.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
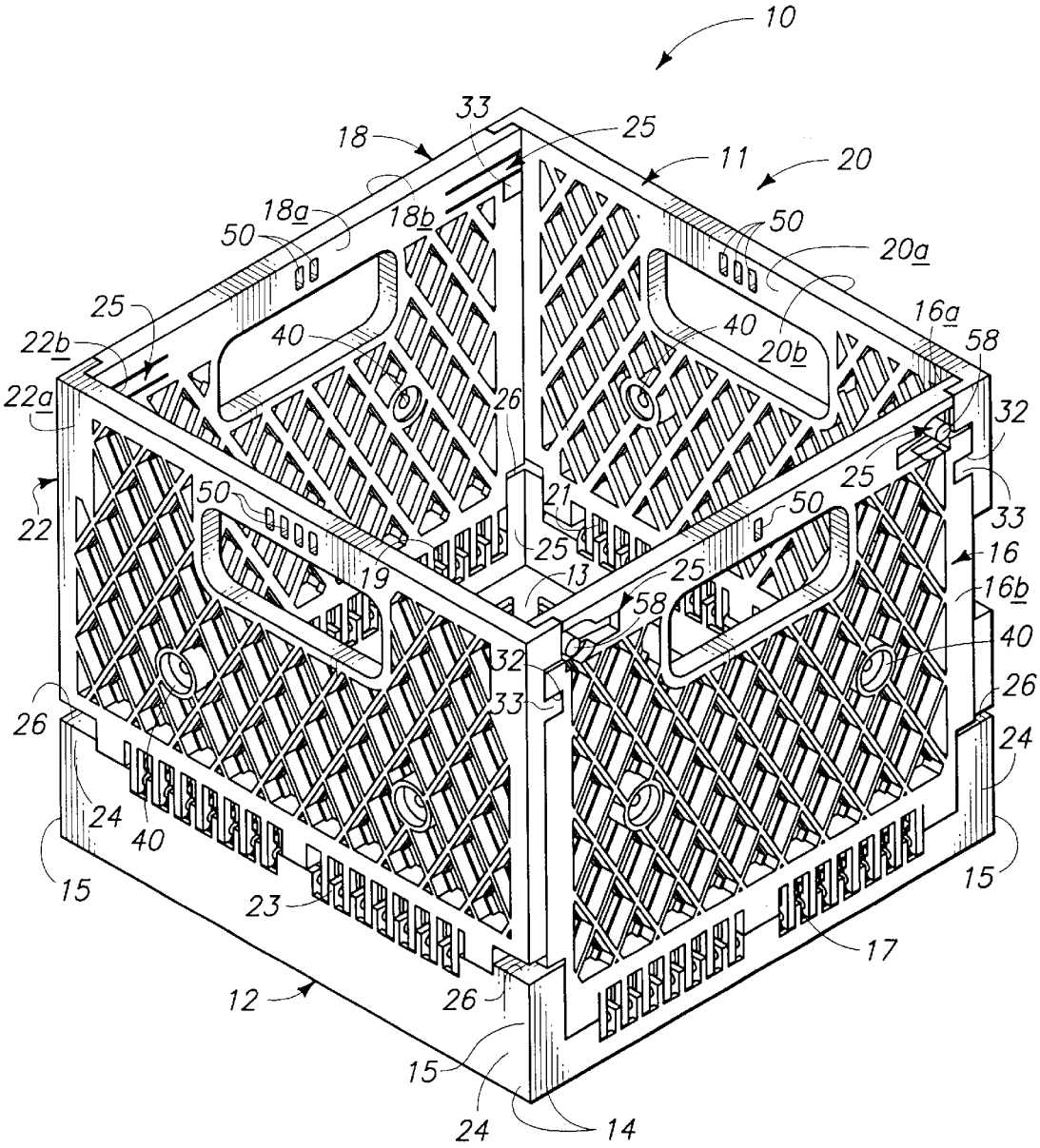
FIG. 1 is a perspective view of a foldable crate incorporating aspects of the present invention and which is shown in an open operative condition.

This disclosure of the invention is submitted in furtherance of the constitutional purposes of the U.S. Patent Laws "to promote the progress of science and useful arts" (Article 1, Section 8).

Before describing details of preferred elements and operations, a general description will be given of basic aspects of the crate.

In one aspect, the folding crate 10 is comprised of a base 12 having a perimeter 14. Side walls 16, 18, 20, 22 are pivotably mounted to the base 12 and fold from an open operative condition to a stacked storage condition in which the sidewalls are in juxtaposition and within the perimeter of the base, forming a stack having a stack thickness T (see example in FIG. 16). Upstanding legs 24 are positioned about the perimeter 14 and project to ends 26 that are spaced from the base 12 by a dimension D greater than the stack thickness. A bottom pedestal 28 is provided on the base 12 in opposition to the legs 24 and is situated inward of the perimeter 14. The pedestal 28 and legs 24 are spaced such that the bottom pedestal 28 of one crate may be received between and secured by the legs 24 of a similar crate 10 with its side walls folded to the stacked storage condition.

In a second aspect, the folding crate 10 includes a base 12 with a first pair of side walls 16, 18 pivotably mounted to the base 12 and which fold from an open operative condition to a stacked storage condition. A second pair of side walls 20, 22 are also pivotably mounted to the base 12 and fold, from an open operative condition adjoining the first pair of side walls to form a wall enclosure having an open top end 11, to a stacked storage condition in juxtaposition with the first pair of side walls and the base. The first pair of side walls each include inner surfaces 16*a*, 18*a* (example illustrated in FIG. 1), outer wall surfaces 16*b*, 18*b*, and latch members 25 that are formed integrally between the inner and outer surfaces such that no part of the latch members 25 project beyond the inner and outer surfaces. The second pair of side walls 20, 22 each include inner and outer wall surfaces 20*a*, 22*a*, and 20*b*, 22*b*. Catch members 27 are formed integrally with the second pair of side walls and are positioned for releasable engagement with the latch members 25 to secure the first and second pairs of side walls 16, 18 and 20, 22 in the open operative position.

In another aspect, the folding crate 10 includes a base 12 and perimeter 14 with a first pair of side walls 16, 18 pivotably mounted to the base 12 and foldable from an open operative condition to a stacked storage condition within the perimeter 14. A second pair of side walls 20, 22 are pivotably mounted to the base 12 and fold from an open operative condition adjoining the first pair of side walls 16, 18 to form a wall enclosure having an open top end 11, to a stacked storage condition within the perimeter 14 and in juxtaposition with the first pair of side walls and the base. The first and second pairs of side walls define a stack thickness in the stacked storage condition. Upstanding legs 24 are positioned about the perimeter 14 and project to ends 26 spaced from the base 14 by a dimension greater than the stack thickness. A bottom pedestal 28 is provided on the base in opposition to the legs 24 and is situated inward of the perimeter 14. The pedestal 28 and legs 24 are spaced such that the bottom pedestal 28 of one crate 10 may be received between and secured by the legs 24 of a similar crate 10 with side walls thereof folded to the stacked storage condition. The first pair of side walls each include inner and outer wall surfaces 16*a*, 18*a* and 16*b*, 18*b*; and latch members 25 that are formed integrally between the inner and outer surfaces such that no part of the latch members 25 project beyond the inner and outer surfaces 16*a*, 18*a*; and 16*b*, 18*b*. The second pair of side walls each 20, 22 include inner and outer wall surfaces 20*a*, 22*a* and 20*b*, 22*b*; and catch members 27 that are formed integrally therein and positioned for releasable engagement with the latch members 25 to secure the first and second pairs of side walls in the open operative position.

In a further aspect, the folding crate 10 includes a base 12, first and second pairs of side walls 16, 18 and 20, 22 pivotably mounted to the base and foldable from an open operative condition to a stacked storage condition. Latch members 25 on the first pair of side walls 16, 18 and catch members 27 on the second pair of side walls 20, 22 are positioned to releasably interfit and releasably lock the first and second pairs of side walls in the open operative condition. At least one of the side walls includes a connector receiver 40 positioned thereon for interconnection with a similar connector receiver 40 on a side wall of a similar crate 10. A link member 41 is releasably receivable by the connector receiver 40 and by the similar connector receiver 40 of the other crate 10 to secure the one side wall to the similar crate. A fastener 46 is also releasably receivable through the connector receiver, link member, and the similar connector receiver on the other crate to fasten the crates together.

Figure 2:
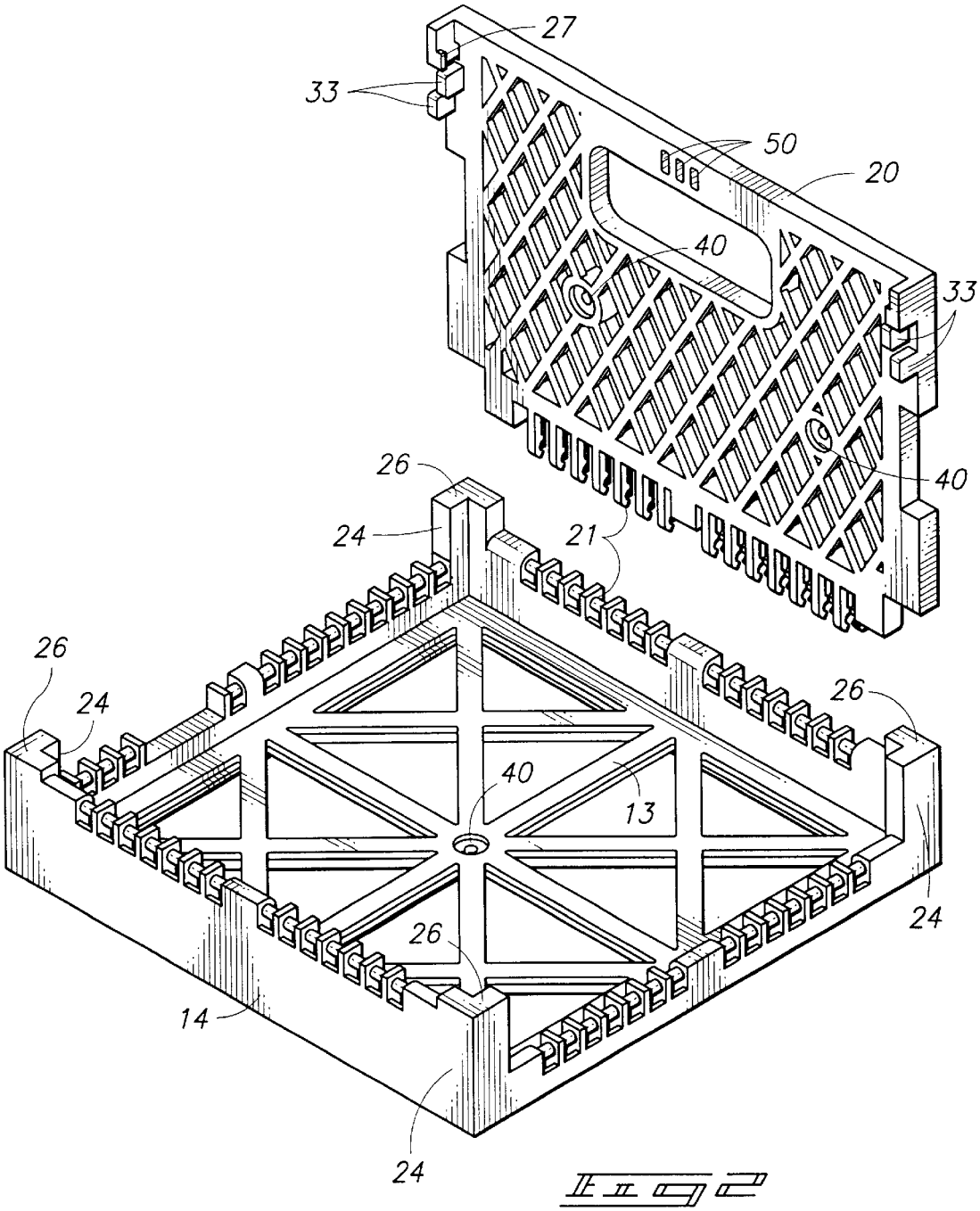
FIG. 2 is a fragmented perspective view of a base and one side wall removed therefrom.

Referring now in particular detail to preferred components of the crate 10, reference first will be made to particular details regarding the base 12. FIG. 2 illustrates the base 12 as including the perimeter 14 which includes hinges 17, 19, 21, and 23 which are integrally formed about the perimeter 14 at progressively spaced elevations from the top surface 13 of the base 12. The hinges are progressively spaced in order to facilitate juxtaposition of the side walls in the stacked storage condition. Thus, the hinge axes are spaced from one another by the approximate thickness dimension of the side walls.

Figure 16:
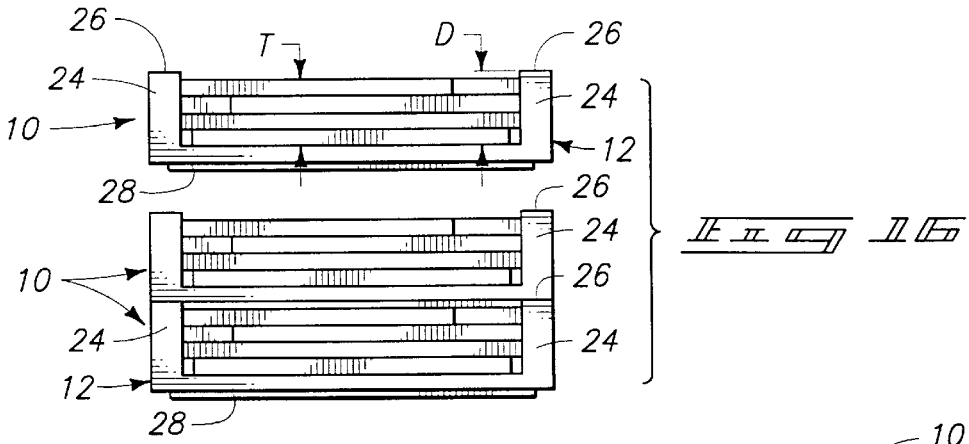
FIG. 16 is an exploded side elevation view of several similar folding crates being stacked, with the side walls thereof oriented in the stacked and folded condition.

The legs 24 are preferably situated at the corners of the base 12 and project upwardly from the top surface 13 to the top ends 26 which are spaced just slightly above the thickness dimension of the stacked side walls (see FIG. 16). The legs are situated at these positions and are spaced apart in order to receive a bottom pedestal 28 on the base of the next successive crate 10 in a stack (again refer to FIG. 16). Thus, the top ends 26 of the legs are spaced above the stack thickness by a dimension substantially equal to the thickness dimension of the pedestal 28. The legs are also spaced around the perimeter to receive the complimentary-shaped pedestal, thereby securing the next folded crate in a stack and allowing numerous crates to be stacked one on another in a substantially secure, nested column.

The crate base 12 also includes one of the crate connector receivers 40 which is integrally formed within the base material and is preferably situated as shown in FIG. 2 at the approximate center of the base. The crate connector receivers will be described in greater detail below following description of the preferred side wall arrangements.

Figure 17:
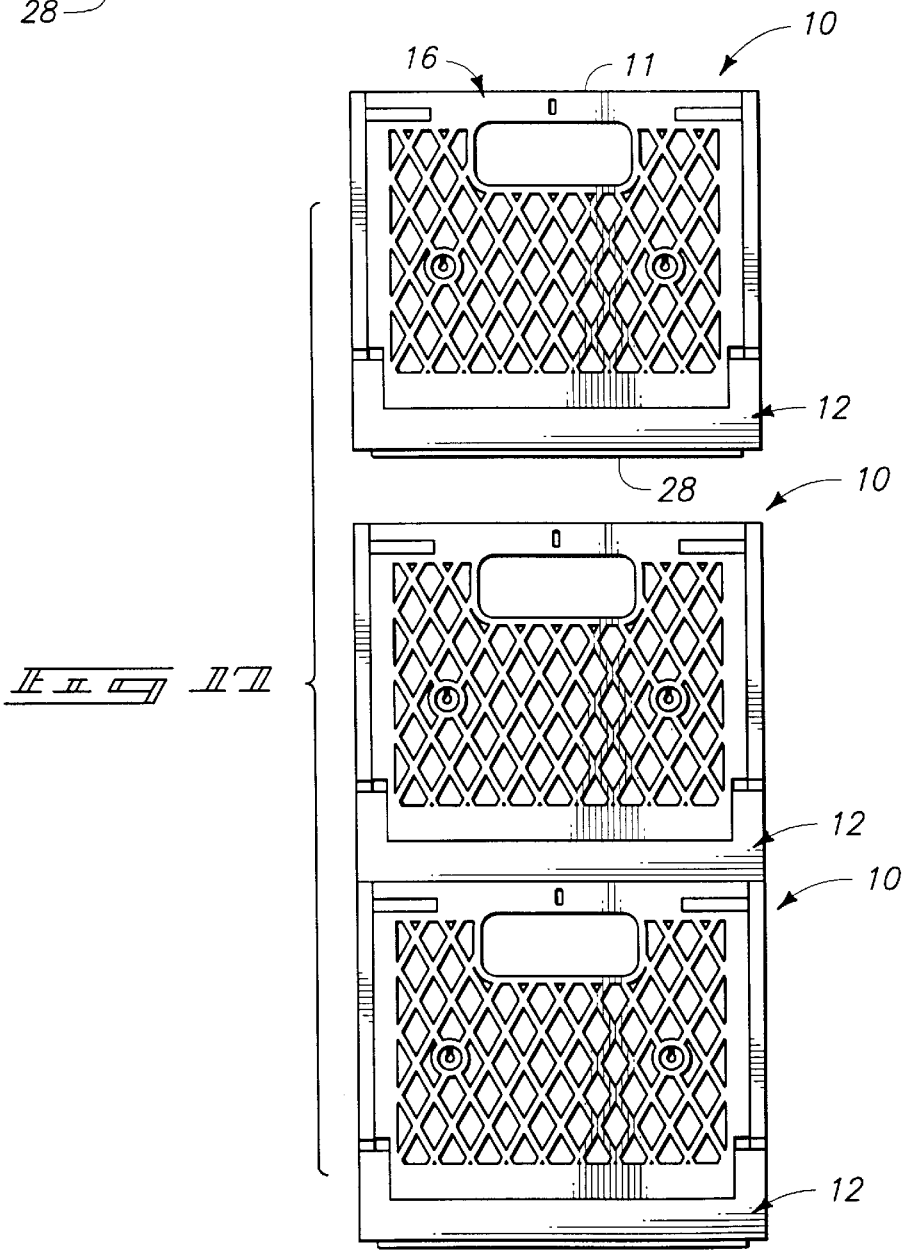
FIG. 17 is a view similar to FIG. 20 only showing the same crates being stacked when in the open operative condition.

It is also pointed out that the hinges 17, 19, 21, and 23 are formed between the base and the respective side walls. That is to say, the completed hinges are formed such that one-half of the hinge element is formed integrally with the base and the other half of the respective hinge elements are formed in the side walls. In the illustrated example, the hinges include hinge pins that are formed along the base. However, the pins could also be formed in a reverse configuration, with the pins being provided on the side walls and the clip members that form the remainder part of the hinges being formed on the base. In either example, it is preferable that the hinges be situated about the perimeter so the side walls, when opened, will define a top opening at the open top end 11 that is also complimentary to the bottom pedestal 28. Thus, a stack of opened crates may be formed as shown in FIG. 17 in the same manner as the folded stack as shown in FIG. 16. In fact, in preferred forms, it is possible to include folded and unfolded crates in the same stack.

Figure 3:
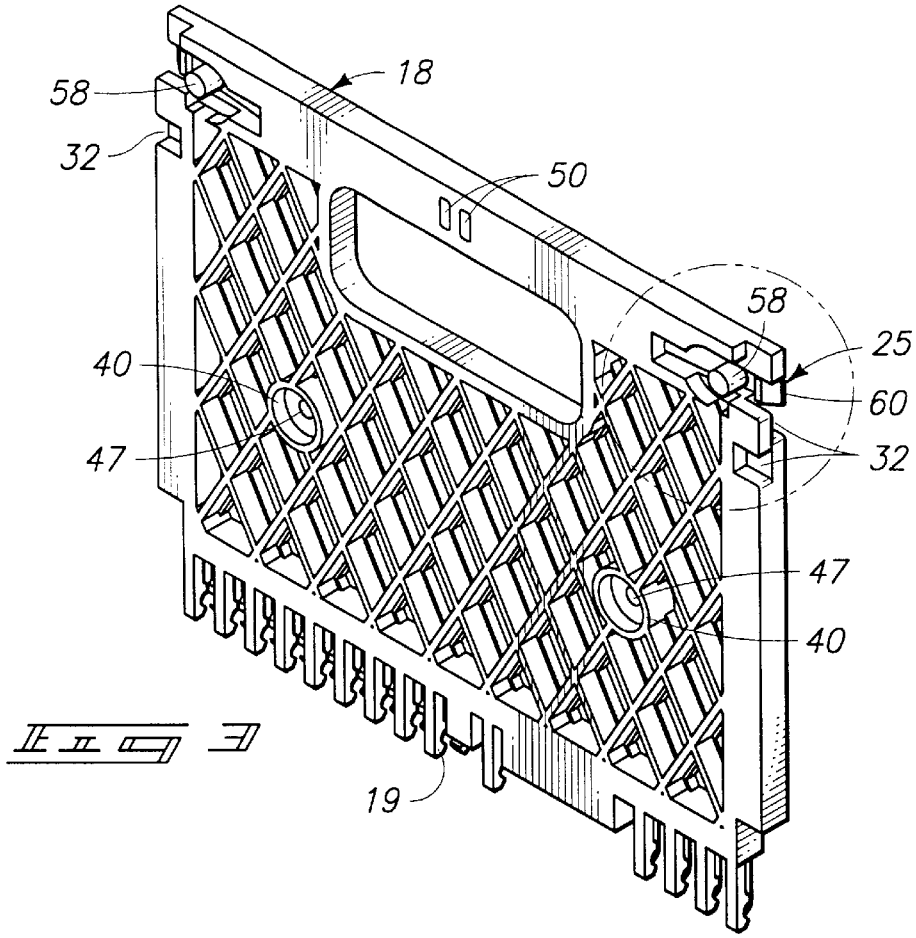
FIG. 3 is a perspective view of another side wall.
Figure 4:
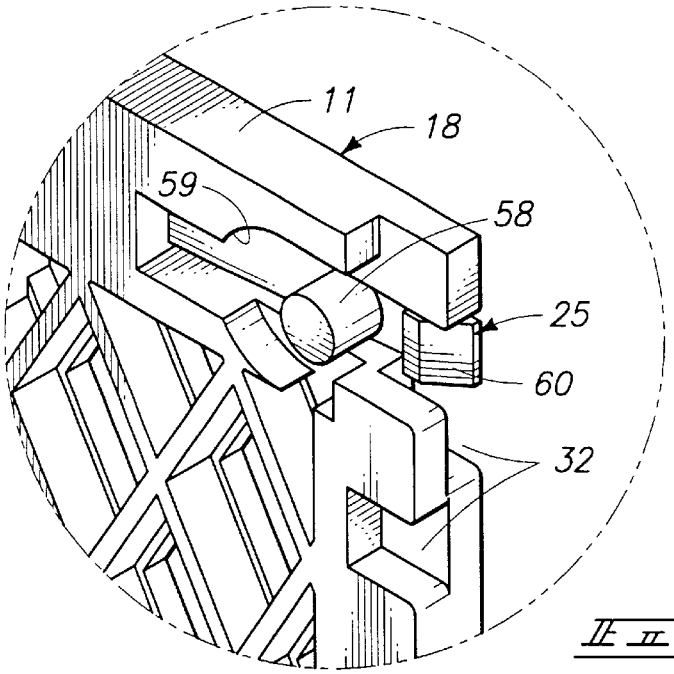
FIG. 4 is an enlarged perspective detail view of an area identified by a circular phantom line in FIG. 3.
Figure 5:
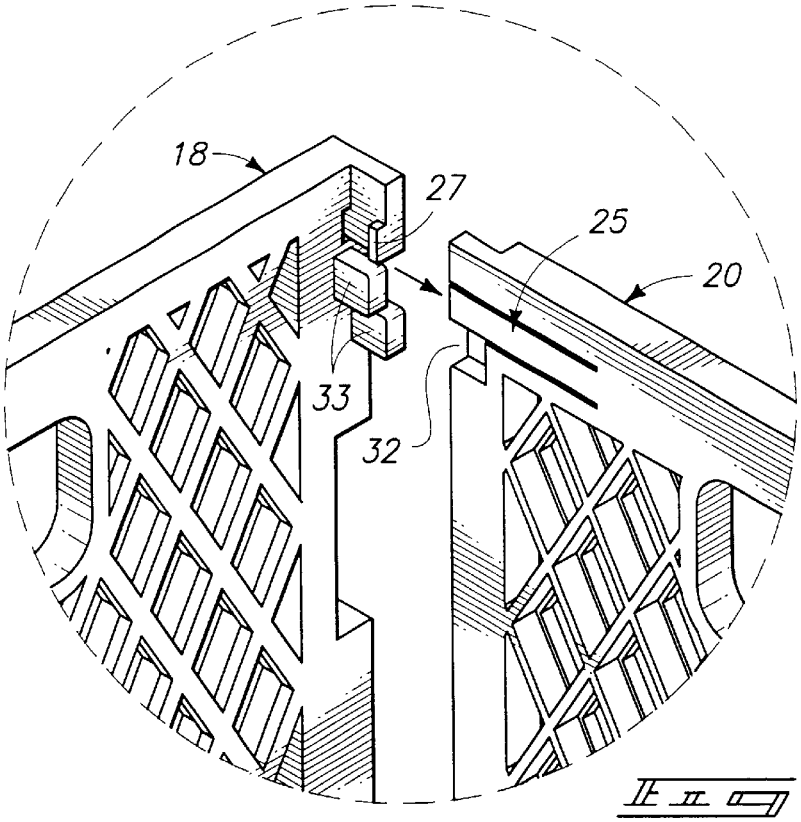
FIG. 5 is an enlarged detail perspective inside angle view showing two adjacent side walls about to be joined together.

Reference should now be drawn with respect to the first pair of side walls 16, 18, a specific example of which is shown by detail in FIGS. 3 and 4. It is pointed out that the first pair of side walls 16, 18 may be nearly identical, with differences being identifiable with respect to the side wall heights as determined by the necessary location of the hinge axes. Thus, the first side wall 16 will be greater in height from its hinge 17 to the top edge than the second side wall 18. The difference in height would be roughly equivalent to the thickness of the side walls between inner surfaces 16A, 18A, and the outer surfaces 16B, 18B. Other distinctive features between the first and second side walls 16, 18 may be provided in the form of indicia or markings 50. The first side wall 16 may include a single marking 50 to identify that wall as the first wall to be folded. The second side wall 18 may include two of the markings 50 to identify that wall as the second wall to be folded. Reference to FIG. 1 will show three markings 50 on the third side wall 20 and four on the fourth side wall 22. Such markings 50 identify the folding order of the walls to eliminate any possible confusion to those wishing to properly fold the walls to the closed, stacked condition.

The first pair of side walls which in the presently illustrated example are comprised of side wall 16, and side wall 18, also include the latch members 25. These members 25 are preferably positioned on opposite end edges of the side walls and are most preferably formed integrally therewith. The latches may be substantially identical and as such, description of one latch member will suffice for description of all four.

Figure 10:
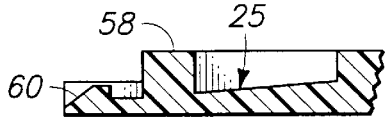
FIG. 10 is a sectional view taken along line 10—10 in FIG. 9.
Figure 8:
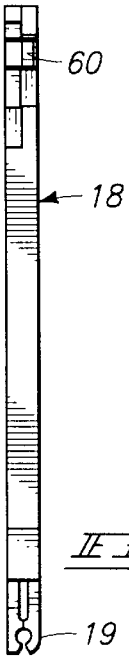
FIG. 8 is an end elevation view of a side wall.
Figure 9:
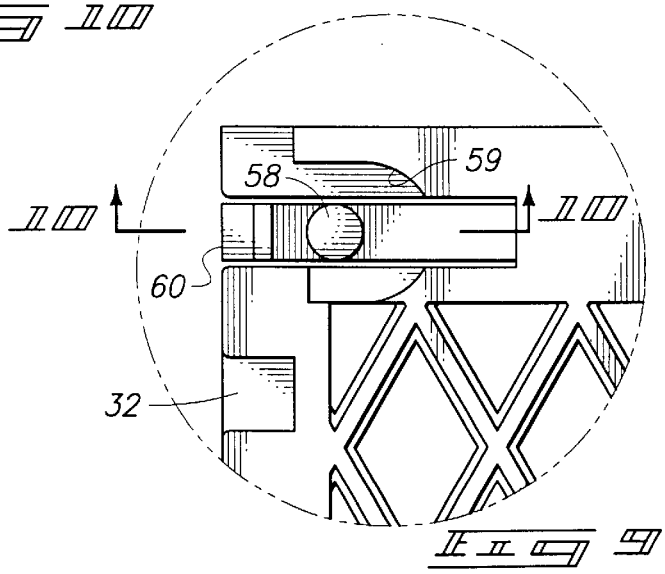
FIG. 9 is an enlarged detail view of the area within a phantom line circle in FIG. 7.
Figure 11:
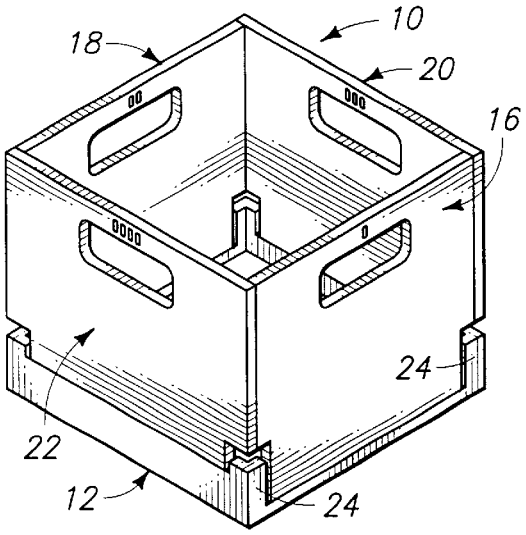
FIGS. 11–15 is a sequence of schematic views illustrating folding of the side walls from the open operational condition to the stacked folded condition.
Figure 12:
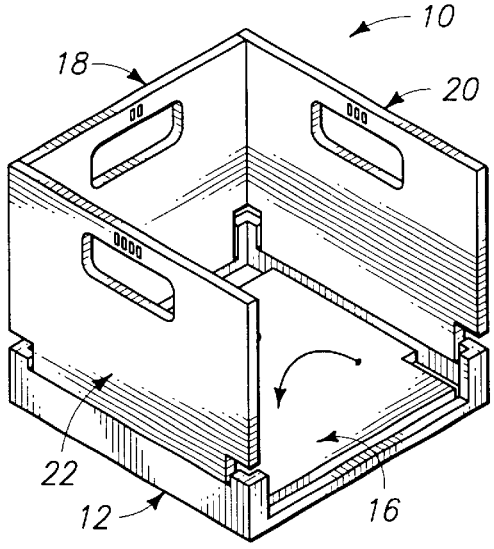
Figure 13:
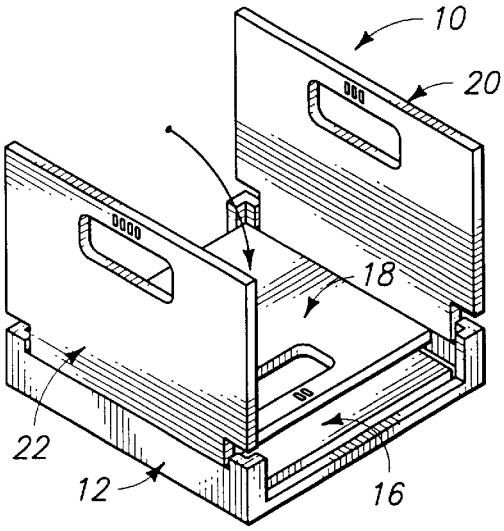
Figure 14:
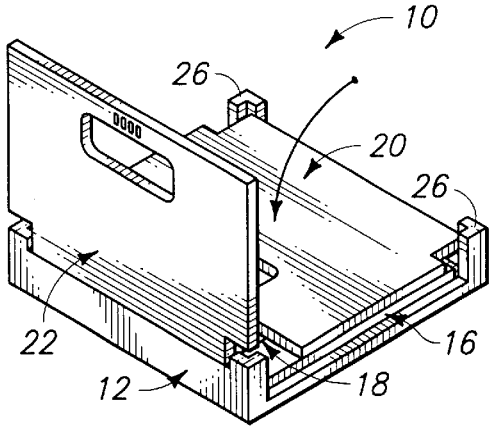
Figure 15:
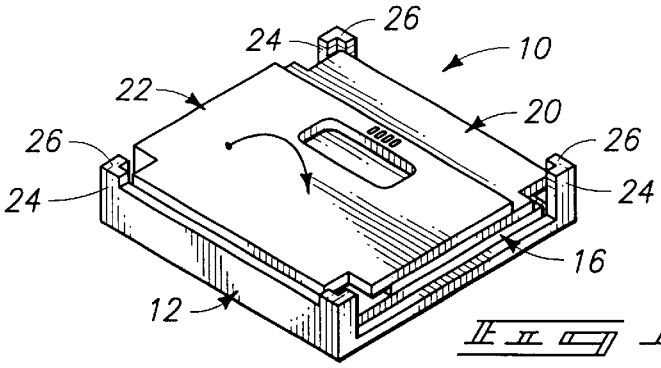

Attention is drawn to FIGS. 4, 9, and 10 which are illustrative of a preferred exemplary latch configuration. As shown and as preferred, the latch members 25 are formed integrally with the first and second side walls, preferably adjacent the upper edges thereof. The latch members 25 are most preferably yieldable and may be formed into leaf spring configurations formed by cutting away or otherwise relieving a portion of the side wall between the inner and outer wall surfaces, leaving a narrowing leaf spring configuration.

Each of the leaf spring shaped members may extend along the associated side walls to actuator members 58 that are disposed within associated recesses 59 that are formed in the first pair of side walls and that open along the outer surfaces thereof. The actuators 58 preferably do not project outwardly beyond the outer surfaces 16B, 18B of the side walls 16, 18. Thus, the first side walls present a substantially smooth outer surface that will not readily catch on other surfaces or present the actuators in such a manner that they couldn't be easily operated to disengage the latches from the catch members on the remaining two side walls.

The outward or free ends of the latch members are provided with cam or barb configurations 60 which are provided to cam or react against the catch members, springing the latch members inwardly as the second side walls are moved to the open condition. The catch members will engage in cam the latch members inwardly until they snap over the catch members and securely hold both wall sections in place.

Structural reinforcement is provided for the first and second pairs of side walls by provision of the mortise and tenon arrangements 32, 33. In the illustrated example, the mortise arrangements are provided on the first and second side walls, while the tenon arrangements are provided on the third and fourth (or second pair) of side walls. It is entirely conceivable that the mortise and tenon arrangement be reversed, or alternated between the respective side wall arrangements. However, it is preferred that some form of mortise and tenon arrangement be provided in order to strengthen and brace the respective adjacent side walls in the open condition.

Figure 6:
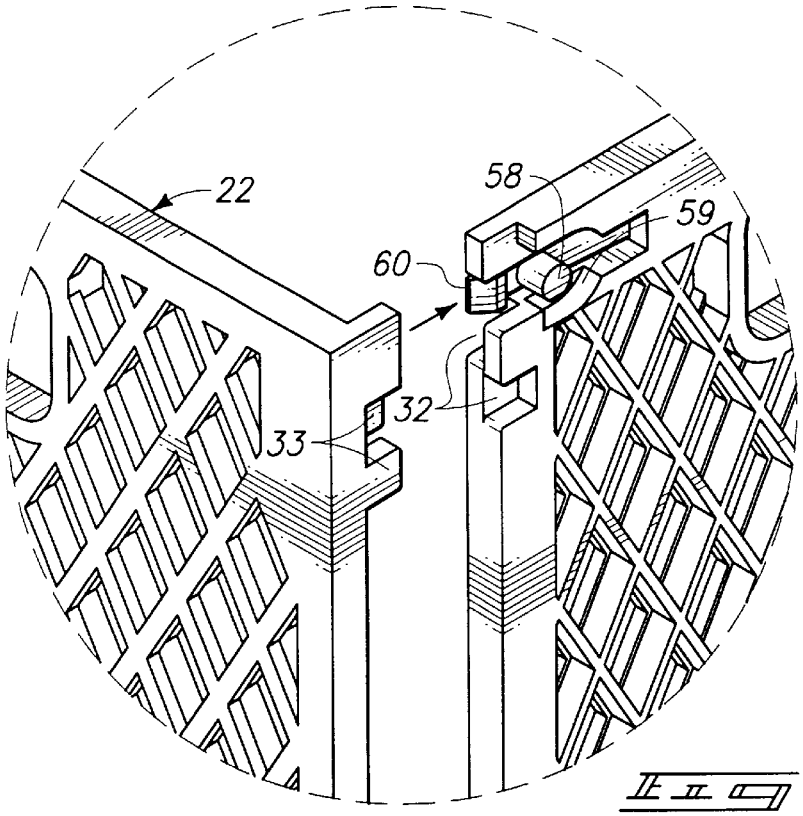
FIG. 6 is a view similar to FIG. 5 only showing the elements thereof from a different, outside angle.
Figure 7:
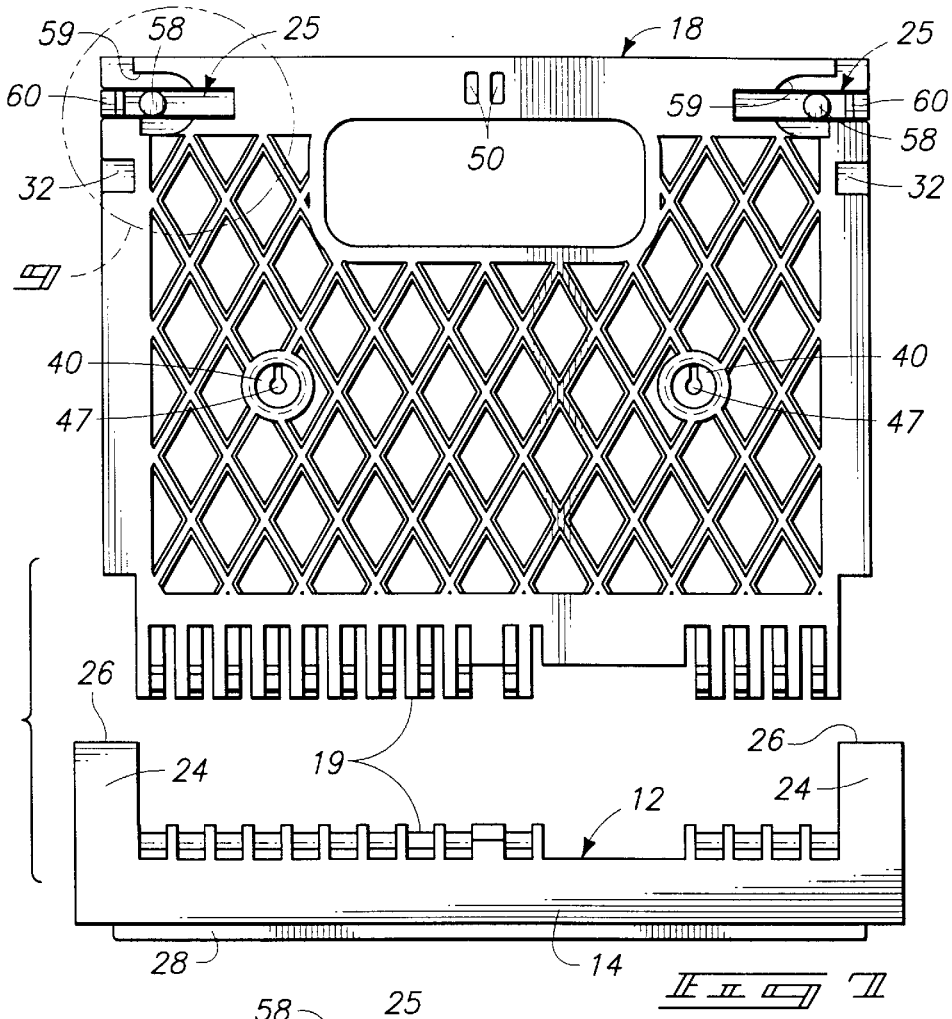
FIG. 7 is an exploded orthographic elevation of a side wall and the base.

The mortise and tenon configurations may take a substantially rectangular form as illustrated by the examples shown in FIGS. 6 and 7. Once again, however, other configurations could be utilized. Further, it is possible for the tenons and mortises to be reversed from the example shown.

It is pointed out that in the illustrated examples, the mortises are formed with one adjacent an outer wall and an adjacent mortise formed adjacent the inner wall. The tenons are complimentary in position on the second pair of side walls 20, 22, thereby substantially sandwiching the first pair of side walls 16, 18 when the walls are interlinked in the open condition. The mortises and tenon arrangements fit snugly together when the side walls are situated in their interlocked, open condition, and the walls are thereby structurally braced.

In order to open the crate from a folded condition, the side walls are progressively pivoted about their respective hinge axes to the open condition. The second set of side walls may be pivoted just slightly outward of the latch members to facilitate alignment of the latch members with the catch members. When rough alignment is achieved, the second pair of side walls may be forcibly moved inwardly to engage the respective catch members 27 against the latch members 25, springing the latch members inwardly to snap over the catch members.

It is pointed out that once in the interlocked positions, the latch members 25 and catch members 27 do not project inwardly or outwardly of the adjacent inner or outer side wall surfaces. The preferred latch member actuators 58 are positioned to be normally flush or slightly inward of the outer side wall surfaces. The catch members 27 are also configured and positioned so as not to deflect the actuators 58 or other surfaces of the latch members 25 beyond the inner or outer surfaces of the first side wall pair.

Once the latch members 25 are effectively engaged with the catch members 27, the crate will be formed in a relatively rigid construction by the interlinked members (25, 27), and by the interfitting orientation of the mortise and tenon elements 32, 33. The result is a strong, rigid crate structure that will not easily become disengaged or accidently unlatched.

Reference is made to the schematic drawings in FIGS. 11–15, which show the procedure taken to shift the crate 10 from the open to the stacked, storage condition. Initially, the first side wall 16 is disengaged by depressing the associated actuators 58 to disengage the catches 27 of the adjacent third and fourth walls. This frees the first side 16 wall to fold inwardly into flush juxtaposition with the top surface 13 of the base 12.

The same procedure is followed for the second side wall 18. The second side wall 18 is disengaged from the third and fourth side walls and is folded into flush juxtaposition with the first, previously folded side wall 16. The folding procedure is repeated for the third and fourth side walls (which are now disengaged from the first and second side walls) to achieve the completely folded condition. The folded crate may now be stored or stacked in a very compact condition.

Figure 20:
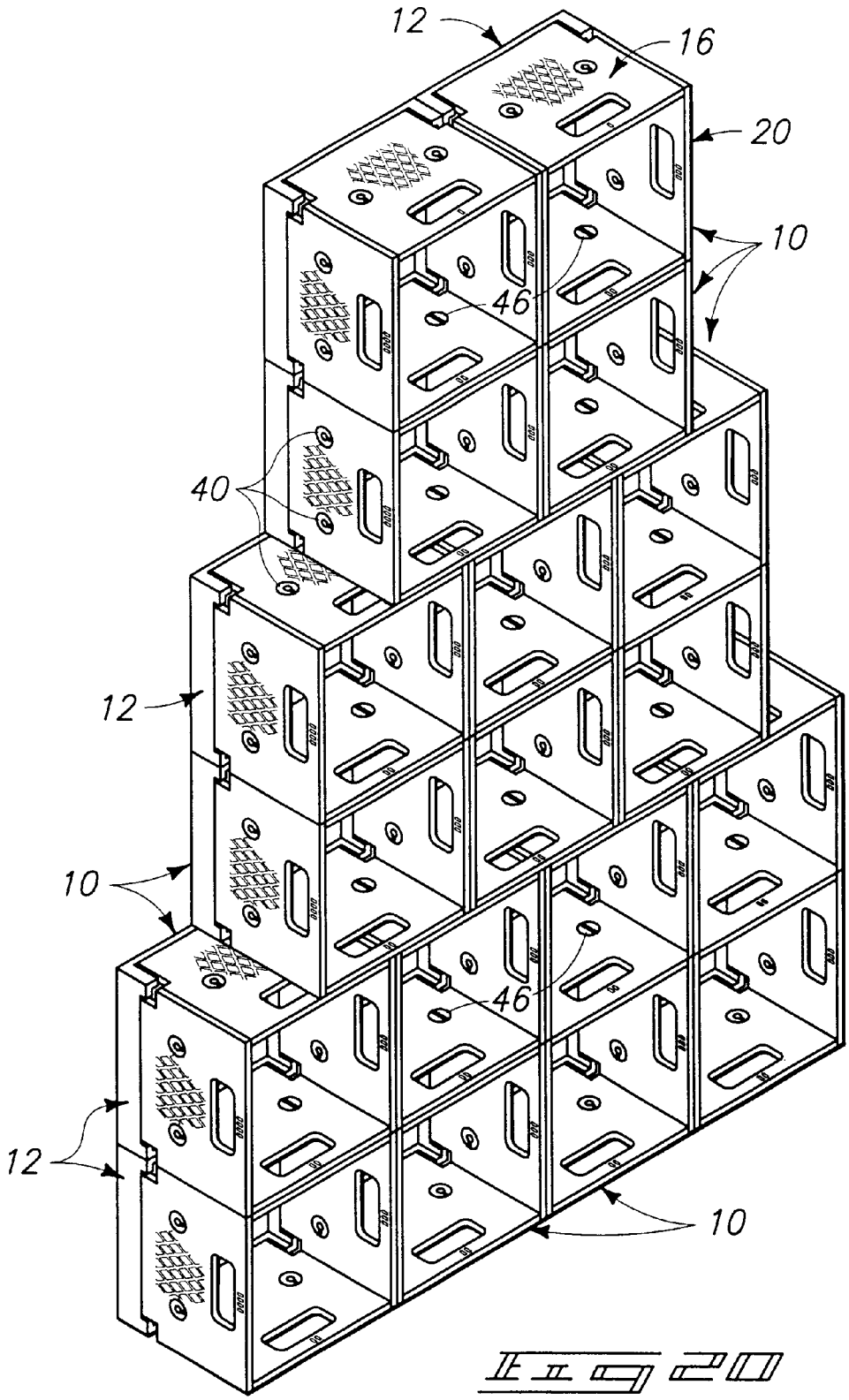
FIG. 20 is a diagrammatic perspective view showing a plurality of the crates being arranged and joined together as a display.

As indicated earlier, the crate receivers 40 may be provided on the base and along any or all of the side walls, The receivers 40 are preferably formed as sockets, molded into or otherwise formed in the side wall material. The receivers 40 are spaced identically and in such an arrangement that a succession of crates 10 may be aligned with one another, or otherwise oriented with the sockets in aligned, facing orientations. Aligned and facing receivers 40 of two crates may be interlinked or fastened together to secure the crates in a desired presentation as exemplified by the pyramid pattern shown in FIG. 20. This capability permits use of the crates as decorative storage or display devices.

Figure 18:
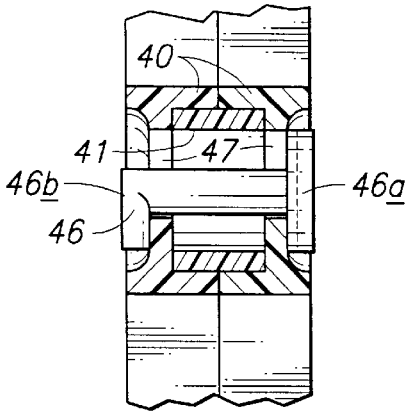
FIG. 18 is an enlarged fragmented sectional view showing connector receivers and a link for joining successive crates together.
Figure 19:
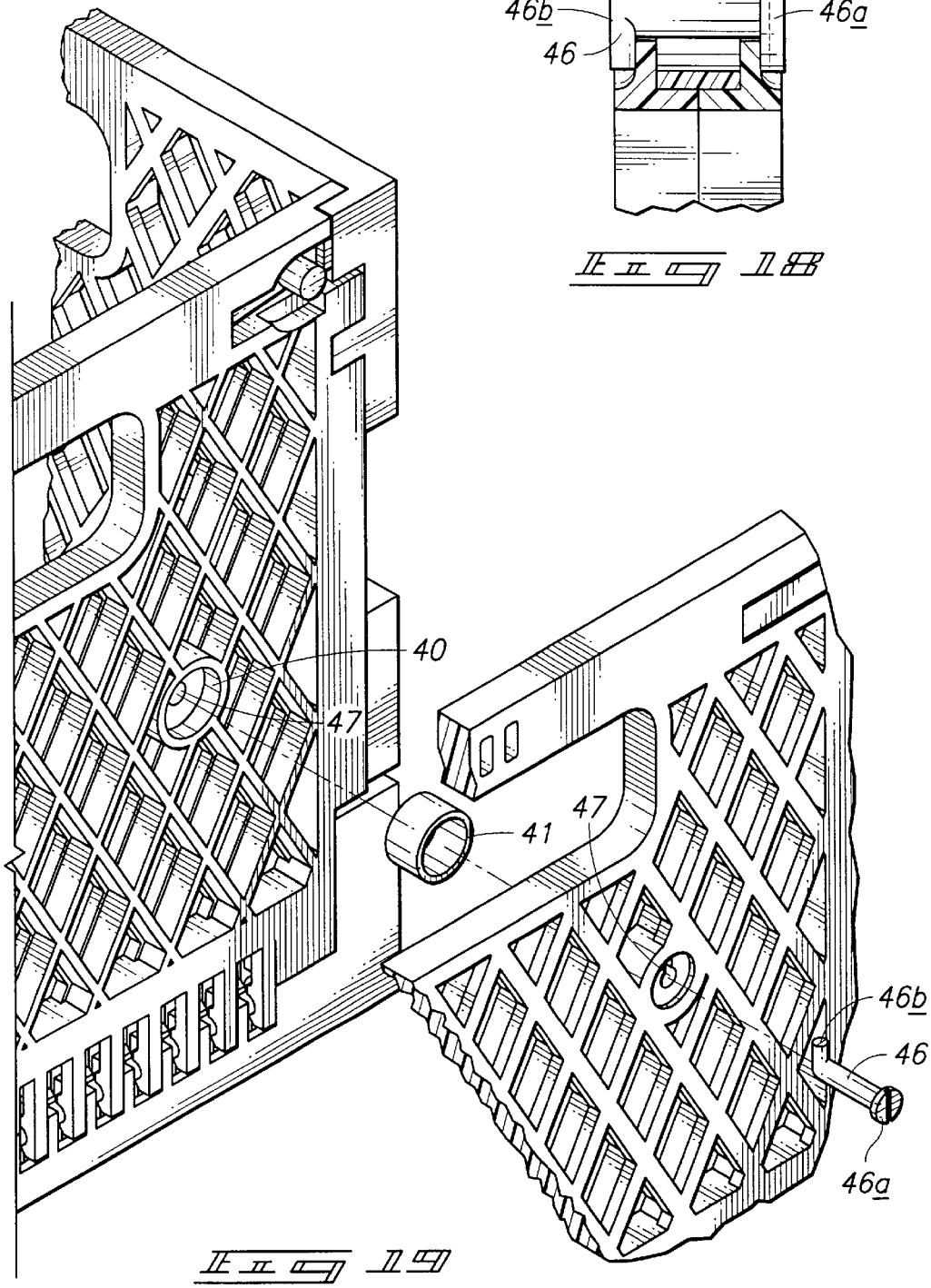
FIG. 19 is an exploded and enlarged fragmented perspective view showing a link and connector receivers along with a key fastener used to secure two crates together.

The receivers 40 are shaped, as shown in detail by FIG. 18 to receive link members 41. The individual link member 41 may be of a simple tubular configuration that is complimentary to the socket configuration of the receivers 40. A link member 41 may be fitted into adjacent facing receivers 40 to engage socket end walls (see FIGS. 18 and 19) to lock the adjacent side walls (and crates) against relative motion with respect to one another.

In a preferred form, J-hook type fasteners 46 may be provided to fit through keyholes 47 formed in the respective adjacent side walls or base wall. The J-hook fasteners 46 may include a slotted head 46*a* and an opposed hooked end 46*b*. The slots may be oriented in the heads 46*a* to be substantially parallel to the hooked end 46*b* in order to identify the position of the hooked end to the user.

The hooked end 46*b* of a J-hook fastener 46 will fit through the aligned keyholes 47 of the adjacent crates. Once received through the aligned keyholes 47, the fasteners 46 may be turned such that the headed end 46*a* and hooked end 46*b* substantially lock the crates together.

The receivers 40 are preferably flush with the side walls and base and therefore do not interfere with normal functioning of the crates for normal, storage purposes. However, if it is desirable to utilize the crates as a display for retail or other purposes, it is a simple and effective procedure to lock the crates together using the integral receivers 40 and the interfitting link members 41, along with the jay hook devices 46 in the manner described above. Through the above provisions, an array or stack of interlocked crates can be easily and quickly assembled with reasonable assurance that the resulting structure will be fairly stable.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus forming a folding crate which can be moved between an open condition and a closed condition and which may be connected to another of said apparatus configured in said open condition, comprising:

a base;

walls adapted for pivotal engagement with the base and capable of pivotal movement between said open condition wherein said walls are extended relative to the base to form a crate and said closed condition in which the walls are substantially parallel with said base to form a stacked arrangement upon the base;

engagement locks on said walls which may be released or locked; when locked, said engagement locks connecting between adjoining wails of said walls when the walls are in the open condition;

at least one connector receiver formed in at least one of said walls or base, each said connector receiver having a receiver socket with a receiver socket end wall having a through hole therein socket;

at least one tubular link adapted to fit into said receiver socket to prevent adjacent side walls of said crate and a similar crate against relative motion with respect to one another when a similar crate is joined thereto;

at least one fastener of sufficient length for extending through said at least one tubular link and two of said receiver socket end walls to allow fastening of two crates thereby when a similar crate is joined thereto.

2. An apparatus according to claim 1 and wherein the at least one receiver socket is molded into the walls or base.

3. An apparatus according to claim 1 and wherein the walls include a plurality of connector receivers in each wall.

4. An apparatus according to claim 1 and wherein the walls include a plurality of connector receivers in each wall positioned to allow a single crate to be joined to two adjacent similar crates along a single wall.

5. An apparatus according to claim 1 and wherein said through holes are keyhole shaped holes.

6. An apparatus according to claim 1 and wherein said at least one fastener is a J-hook fastener.

7. An apparatus according to claim 1 and wherein said at least one fastener has a hooked head that inserts through said through hole.

8. An apparatus according to claim 1 and wherein said at least one tubular link cylindrical.

9. An apparatus capable of forming a crate array of foldable crates in open condition by changing and assembling the foldable crates from a nested column configuration in which multiple crates are stacked together in nested relationship while the crates are in closed condition, comprising:

a plurality of crate units each of said crate units having:

a base;

walls adapted for pivotal engagement with the base and capable of pivotal movement between said open condition wherein said walls are extended relative to the base to form a crate and said closed condition in which the walls are substantially parallel with said base to form a stacked arrangement upon the base;

engagement locks on said walls which may be released or locked; when locked, said engagement locks connecting between adjoining walls of said walls when the walls are in the open condition;

at least one connector receiver formed in least one of said walls or base, each said connector receiver having a receiver socket with a receiver socket end wall having at least one through hole therein;

at least one tubular link adapted to fit into said receiver socket to prevent adjacent side walls of said crate and a similar crate against relative motion with respect to one another when a similar crate is joined thereto;

at least one fastener of sufficient length for extending through said at least one tubular link and two of said receiver socket end walls to allow fastening of two crates thereby when a similar crate is joined thereto.

10. An apparatus according to claim 9 and wherein the at least one receiver socket is molded into the walls or base.

11. An apparatus according to claim 9 and wherein the walls include a plurality of connector receivers in each wall.

12. An apparatus according to claim 9 and wherein the walls include a plurality of connector receivers in each wall positioned to allow a single crate to be joined to two adjacent crates along a single wall.

13. An apparatus according to claim 9 and wherein said through holes are keyhole shaped holes.

14. An apparatus according to claim 9 and wherein said at least one fastener is a J-hook fastener.

15. An apparatus according to claim 9 and wherein said at least one fastener has a hooked head that inserts through said through holes.

16. An apparatus according to claim 9 and wherein said at least one tubular link is cylindrical.

* * * * *

UNITED STATES PATENT AND TRADEMARK OFFICE

CERTIFICATE OF CORRECTION

PATENT NO. : 6,722,515 B2
DATED : April 20, 2004
INVENTOR(S) : Donald Rumpel

It is certified that error appears in the above-identified patent and that said Letters Patent is hereby corrected as shown below:

Column 7,
Line 37, after “therein” delete “socket”.

Column 8,
Line 7, after “link”, insert -- is --.
Line 25, after “in”, insert -- at --.

Signed and Sealed this

First Day of June, 2004

JON W. DUDAS
*Acting Director of the United States Patent and Trademark Office*